US011585641B2

(12) United States Patent
Speyer et al.

(10) Patent No.: US 11,585,641 B2
(45) Date of Patent: Feb. 21, 2023

(54) ARMOR COMPONENT AND METHOD OF MAKING THE ARMOR COMPONENT

(71) Applicants: Robert F. Speyer, Atlanta, GA (US); John Shupe, Atlanta, GA (US)

(72) Inventors: Robert F. Speyer, Atlanta, GA (US); John Shupe, Atlanta, GA (US)

(73) Assignee: VERCO MATERIALS, LLC, Atlanta, GA (US)

( * ) Notice: Subject to any disclaimer, the term of this patent is extended or adjusted under 35 U.S.C. 154(b) by 65 days.

(21) Appl. No.: 17/324,360

(22) Filed: May 19, 2021

(65) Prior Publication Data

US 2021/0341263 A1 Nov. 4, 2021

Related U.S. Application Data

(62) Division of application No. 16/445,995, filed on Jun. 19, 2019, now Pat. No. 11,047,651.

(60) Provisional application No. 62/687,436, filed on Jun. 20, 2018.

(51) Int. Cl.

| | |
|---|---|
| ***F41H 5/04*** | (2006.01) |
| ***F41H 1/02*** | (2006.01) |
| ***F41H 5/013*** | (2006.01) |

(52) U.S. Cl.
CPC ..... *F41H 5/0492* (2013.01); *F41H 1/02* (2013.01); *F41H 5/013* (2013.01)

(58) Field of Classification Search
CPC ... F41H 5/04; F41H 1/02; F41H 5/013; B23B 18/00; B23B 2309/12; B23B 2260/023; B23B 2250/00; B23B 2250/04
See application file for complete search history.

(56) References Cited

U.S. PATENT DOCUMENTS

| | | | | |
|---|---|---|---|---|
| 8,434,396 | B1 | 5/2013 | Wiley et al. | 89/36.01 |
| 9,677,858 | B1 | 6/2017 | Speyer et al. | 89/36.02 |
| 11,047,651 | B2 * | 6/2021 | Speyer | F41H 5/0414 |
| 11,226,178 | B1 * | 1/2022 | Goepfert | F41H 5/007 |
| 2012/0263727 | A1 | 10/2012 | Baker | 424/139.1 |
| 2014/0076139 | A1 | 3/2014 | Bergman | 89/36.02 |
| 2015/0184979 | A1 | 7/2015 | Moran | 2/2.5 |
| 2016/0025460 | A1 | 1/2016 | Sayre | 89/36.08 |

* cited by examiner

*Primary Examiner* — J. Woodrow Eldred
(74) *Attorney, Agent, or Firm* — Ostrolenk Faber LLP

(57) ABSTRACT

An armor component that includes a ballistic tile made of, for example, boron carbide or silicon carbide, a plurality of wraps made of ballistic fibers such as carbon fiber, and a metal plate, for example, a steel plate, the metal plate being positioned behind the reverse side of the tile and the wraps being wrapped around the tile and the metal plate.

11 Claims, 9 Drawing Sheets

ARMOR COMPONENT AND METHOD OF MAKING THE ARMOR COMPONENT

CROSS-REFERENCE TO RELATED APPLICATIONS

The present application is a division of U.S. patent application Ser. No. 16/445,995, filed Jun. 19, 2019, with the title ARMOR COMPONENT AND METHOD OF MAKING THE ARMOR COMPONENT (incorporated by reference), which claims priority to U.S. Provisional Application Ser. No. 62/687,436, filed Jun. 20, 2018, the entire disclosure of which is incorporated by reference herein.

FIELD OF THE INVENTION

The present invention relates to an armor component in which a metal (e.g. steel) sheet insert is used as a part of a containment system.

BACKGROUND

U.S. Pat. No. 8,434,396 (incorporated by reference) discloses a ballistic tile used for an armor arrangement. FIGS. 1A-1C disclose an example of such a tile 10 (FIGS. 1A and 1B) and an imbricated arrangement using the tile 10 (FIG. 1C).

Referring to FIGS. 1A-1C, the tile 10 may include an endless edge 28 between an obverse side 20 and a reverse side 22. The tile 10 includes a profile between the obverse side 20 and the reverse side 22 and intersecting the edge 28. The profile includes a first peripheral boundary 30, a second peripheral boundary 32 opposite the first peripheral boundary 30, a third peripheral boundary 34 extending between the first and the second peripheral boundaries and connected to the first and to the second peripheral boundaries by respective corners 24, and a fourth peripheral boundary 36 opposite the third peripheral boundary 34, extending between the first and the second peripheral boundaries 30, 32 and connected to the first and to the second peripheral boundaries by respective corners 24.

The first and the second peripheral boundaries 30, 32 have one shape, and the third and the fourth peripheral boundaries 34, 36 have another shape different than the one shape.

The obverse side 20 includes a first region 38 and a second region 40 each configured to be overlapped by a corresponding region of a reverse side 22 of another tile 10 to realize an imbricated arrangement as seen in FIG. 1C.

The strike face 21 is not overlapped by another tile, and the first region 38 and the second region 40 are adjacent the strike face 21.

The strike face 21 includes a relief pattern comprising a plurality of single or continuous raised portions. Each raised portion may be arcuate and includes a convex outer surface.

The first and the second regions 38, 40 each includes a feature 42 that registers with a corresponding feature 44 on the reverse side 22 of a respective overlapping tile. The first region 38 and the second region 40 each slopes downwardly from the strike face 21 toward respective first and second peripheral boundaries 30, 32 and are overlapped by corresponding regions on the reverse side of respective tiles.

U.S. Pat. No. 9,677,858 (incorporated by reference) discloses a method of making an armor component by wrapping ballistic tiles in epoxy-impregnated stiff carbon fiber fabric, in which the epoxy is set under elevated temperatures and pressures. FIGS. 2A-2D show the wrapping steps.

The wrapped tiles may be positioned in an imbricated pattern, and vacuum encapsulated in a ballistic fabric with an adhesive coating. As shown in FIGS. 3A-3C, this assembly is in turn sewn to 34 layers of soft ballistic fabric; e.g. aramid or high molecular weight polyethylene. The fabric pack is positioned adjacent to the back face of the fabric-encapsulated assembly of carbon fiber-wrapped ceramic tiles.

SUMMARY OF THE INVENTION

The present invention is an armor component that includes a tile wrapped with a plurality of polymer impregnated wrappers, the tile including an obverse side, a reverse side, and a plurality of corners, and the plurality of wrappers including at least a first wrapper and at least a second wrapper, each wrapper having a central portion and a plurality of leaves surrounding and extending from the central portion, the central portion of the first wrapper residing over the obverse side of the tile, and the leaves of the first wrapper being folded over to the reverse side of the tile; the central portion of the second wrapper residing over the reverse side of the tile, and the leaves of the second wrapper being folded over to the obverse side of the tile and the central portion of the first wrapper; a metal plate positioned between the reverse side of the tile and the central portion of the second wrapper, wherein the obverse side of the tile is the strike face of the tile.

The tile may be formed with boron carbide, the polymer may be a cured epoxy and the wrappers may be made of carbon fiber.

The plurality of wrappers may include at least a third wrapper and a fourth wrapper, each having a central portion, the central portion of the third wrapper residing on the reverse side of the tile between the metal plate and the reverse side of the tile, and the central portion of the fourth wrapper being positioned on the second wrapper, the leaves of the third wrapper and the leaves of the fourth wrapper being folded over the obverse side of the tile, and the leaves of each wrapper of the component have varying lengths, the shortest leaves being closer to the corners of the tile.

The polymer in the first wrapper, and when present, the third wrapper, may penetrate microscopic surface cavities of the tile to mechanically bond the first wrapper, and when present, the third wrapper, to the ceramic tile.

The corners of the tile are rounded.

The tile may include an endless edge between the obverse side and the reverse side, the tile including a profile between the obverse side and the reverse side, the profile including a first peripheral boundary, a second peripheral boundary opposite the first peripheral boundary, a third peripheral boundary extending between the first and the second peripheral boundaries and connected to the first and to the second peripheral boundaries by respective corners, and a fourth peripheral boundary opposite the third peripheral boundary, extending between the first and the second peripheral boundaries and connected to the first and to the second peripheral boundaries by respective corners, the first and the second peripheral boundaries having one shape, and the third and the fourth boundaries having another shape different than the one shape, wherein the obverse side includes a first region and a second region each configured to be overlapped by a corresponding region of a reverse side of another tile, and the strike face that is not overlapped by another tile, the first region and the second region being adjacent the strike face and wherein the strike face includes a relief pattern comprising a plurality of raised portions.

The first and the second regions each includes a feature that registers with a corresponding feature on the reverse side of a respective overlapping tile.

The first region and the second region each slopes downwardly from the strike face toward respective first and second peripheral boundaries and are overlapped by corresponding regions on the reverse side of respective tiles.

Each raised portion is arcuate and includes a convex outer surface.

The strike face includes a relief pattern comprising a single, continuous raised surface.

The tile may be comprised of sintered silicon carbide instead of sintered boron carbide.

A method of making an armor component, includes wrapping a ceramic tile with a plurality of wrappers impregnated with a curable polymer to obtain a wrapped tile, wherein the tile includes an obverse side, a reverse side, and corners, and the plurality of wrappers include at least a first wrapper and at least a second wrapper, each wrapper having a central portion and a plurality of leaves surrounding and extending from the central portion; placing the central portion of the first wrapper over the obverse side of the tile; folding the leaves of the first wrapper over to the reverse side of the tile; placing a metal plate over the reverse side of the tile; placing the central portion of the second wrapper over the metal plate; folding the leaves of the second wrapper over to the obverse side of the tile and the central portion of the first wrapper; and isostatic pressing the wrapped tile to integrate the wrappers, the metal plate and the tile while curing the polymer.

The isostatic pressing may be carried out in a chamber of an isostatic press, and the method may further include initially pressurizing the chamber to a first pressure above atmospheric pressure while at a first, ambient temperature and thereafter further increasing pressure to a second higher pressure, while increasing temperature to a second, higher temperature to cure the polymer, and holding temperature of the chamber for a first period of time at the second temperature to cure the polymer.

The method may further include cooling the chamber from the second, higher temperature to a lower temperature above ambient temperature without venting the chamber to maintain pressure inside the chamber, and then venting the chamber while maintaining the temperature of the chamber above ambient.

The method may further include venting the chamber to atmospheric pressure while maintaining the second, higher temperature for a second period of time.

The method may further include, prior to the isostatic pressing step, sandwiching the wrapped tile between release fabrics to obtain a sandwiched and wrapped tile, placing the sandwiched and wrapped tile in a vacuum bag, evacuating the vacuum bag, thereby squeezing the wrappers into tighter contact with the tile, and sealing the bag to obtain an air-tight enclosure.

The plurality of wrappers may include at least a third wrapper and a fourth wrapper each having a central portion, and the method further may further include placing the central portion of the third wrapper on the reverse side of the tile before placing the metal plate, and placing the central portion of the fourth wrapper on the second wrapper, and folding the leaves of the third wrapper and the fourth wrapper over to the obverse side of the tile, wherein the leaves of each wrapper vary in length, and the shortest leaves are closest to the corners of the tile.

The leaves of the first wrapper and the leaves of the third wrapper may be off-set by reversing the contacting face of the wrapper.

The tile may be symmetric about a symmetry line and the shape and seam positions of the leaves of the wrappers are asymmetric about the symmetry line as described in U.S. Pat. No. 9,677,858.

The wrappers may be star-shaped with leaves that terminate at respective points.

The polymer may be an epoxy and the wrappers may be made of carbon fibers.

A plurality of components may be arranged in an imbricated pattern to make an armor.

Other features and advantages of the present invention will become apparent from the following description of the invention which refers to the accompanying drawings.

DETAILED DESCRIPTION

Figure 1A:
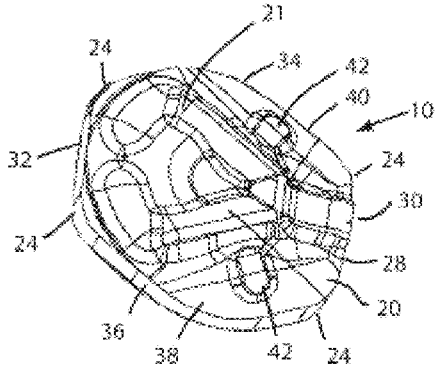
FIG. 1A shows the obverse side of the tile used in a component according to the present invention.
Figure 1B:
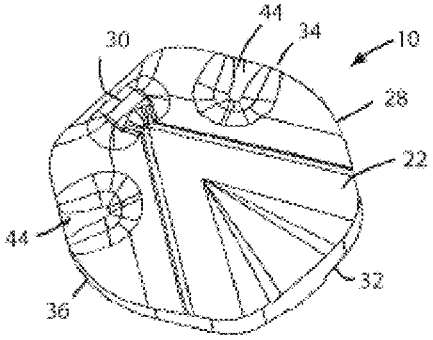
FIG. 1B shows a reverse side of the tile of FIG. 1A.
Figure 1C:
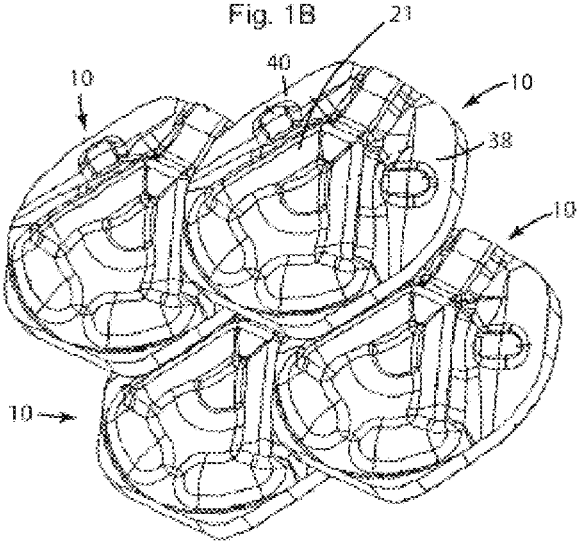
FIG. 1C shows an imbricated tile arrangement using the tiles shown in FIGS. 1A and 1B.
Figures 2A, 2B, 2C, 2D:
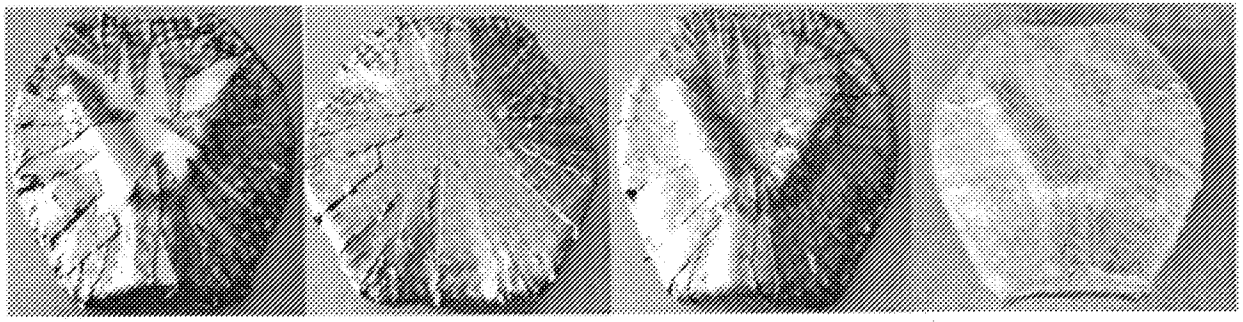
FIGS. 2A-2C show the wrapping sequence of the carbon fiber wraps around a boron carbide tile.
FIG. 2D shows a 3-times wrapped disk after the epoxy was set at an elevated temperature and pressure.
Figures 3A, 3B, 3C:
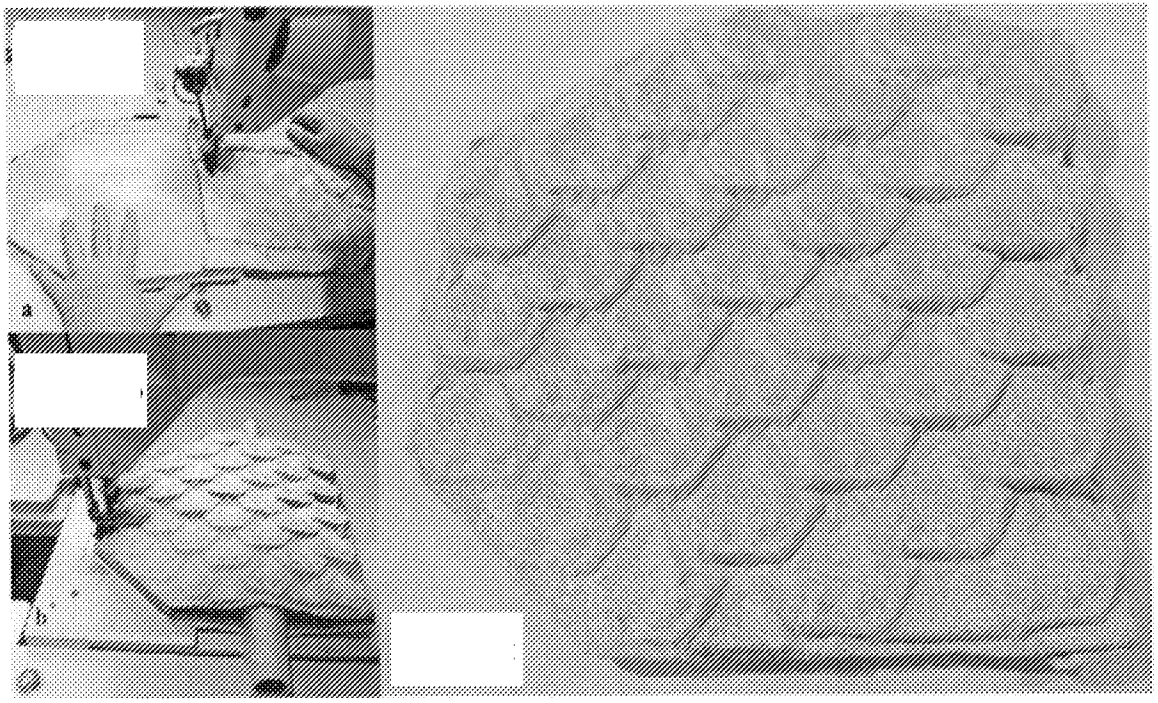
FIGS. 3A-3C show the ballistic fabric backing sewn onto carbon fiber-wrapped boron carbide tiles, whose imbricated pattern is held in place with adhesive attached to the strike face and the back face ballistic fabric sheets.
Figure 4:
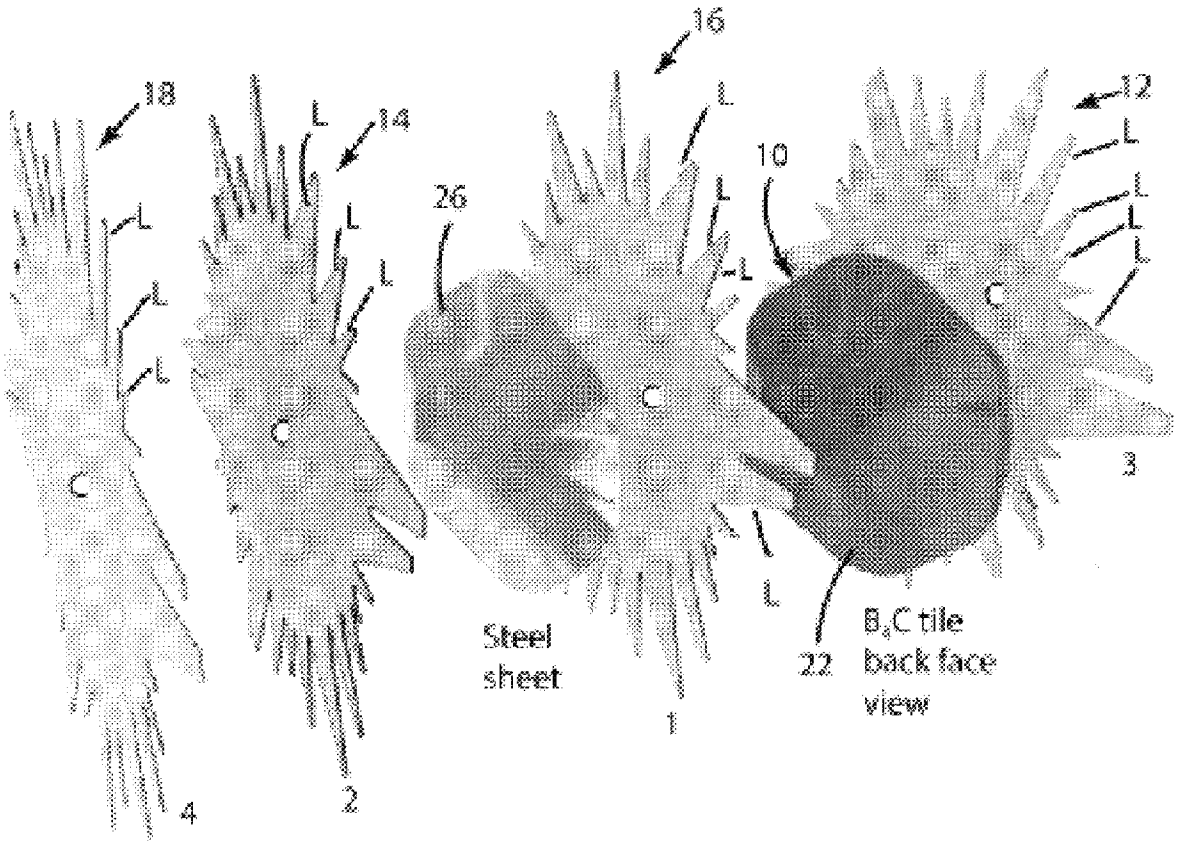
FIG. 4 shows an exploded view of a component according to the present invention.

Referring to FIG. 4, in which like numerals indicate like features, an armor component according to an embodiment of the present invention includes a tile 10 wrapped with a plurality of polymer impregnated wrappers 12, 14, 16, 18, wrapped using the technique disclosed in U.S. Pat. No. 9,677,858 discussed above.

The tile 10 includes an obverse side 20, a reverse side 22, and a plurality of corners 24. The plurality of wrappers 12, 14, 16, 18 include at least a first wrapper 12 and at least a second wrapper 14, each wrapper having a central portion (C) and a plurality of leaves (L) surrounding and extending from the central portion (C).

The central portion (C) of the first wrapper 12 resides over the obverse side 20 of the tile 10, and the leaves (L) of the first wrapper 12 are folded over to the reverse side 22 of the tile 10.

The central portion (C) of the second wrapper 14 resides over the reverse side 22 of the tile 10, and the leaves (L) of the second wrapper 14 are folded over to the obverse side 20 of the tile 10 and the central portion (C) of the first wrapper 12.

A metal plate 26 (e.g. a steel plate) is positioned between the reverse side 22 of the tile 10 and the central portion (C) of the second wrapper 14. The obverse side 20 of the tile 10 is the strike face 21 of the tile 10, which is the face that will be initially hit by the projectile and has the surface configuration discussed above.

The tile 10 may be made of boron carbide, the polymer may be cured epoxy and the wrappers 12, 14, 16, 18 may be made of carbon fiber. The tile 10 may be made of silicon carbide instead of boron carbide.

The component may include at least a third wrapper 16, and a fourth wrapper 18, each having a central portion (C).

The central portion (C) of the third wrapper 16 resides directly on the reverse side 22 of the tile 10 between the metal plate 26 and the reverse side 22 of the tile 10.

The central portion (C) of the fourth wrapper 16 resides directly on the back surface of the second wrapper 14. The leaves (L) of the fourth wrapper 18 are folded over the obverse side 20 of the tile 10.

The leaves (L) of each wrapper 12, 14, 16, 18 may have varying lengths, the shortest leaves being closer to the corners 24 of the tile 10.

The polymer in the first wrapper 12, and when present, the third wrapper 16, may penetrate the microscopic surface cavities of the obverse side 20 of the tile 10 to mechanically bond the first wrapper 12, and when present, the third wrapper 16, to the ceramic tile 10.

The metal plate 26 may conform to the surface topography of reverse side 22 (or the surface topography of the third wrapper 16 when present), and may be only large enough to cover the reverse side 22, and does not extend to obverse side 20.

A method of making an armor component is based on the method disclosed in U.S. Pat. No. 9,677,858, and includes wrapping a ceramic tile 10 with a plurality of wrappers 12, 14, 16, 18 impregnated with a curable polymer to obtain a wrapped tile, wherein the tile 10 includes an obverse side 20, a reverse side 22, and corners 24.

The plurality of wrappers 12, 14, 16, 18 include at least a first wrapper 12 and at least a second wrapper 14, each wrapper 12, 14 having a central portion (C) and a plurality of leaves (L) surrounding and extending from the central portion (C).

The method includes placing the central portion (C) of the first wrapper 12 over the obverse side 20 of the tile 10; folding the leaves (L) of the first wrapper 12 over to the reverse side 22 of the tile 10; placing a metal plate 26 over the reverse side 22 of the tile 10; placing the central portion (C) of the second wrapper 14 over the metal plate 26; folding the leaves (L) of the second wrapper 14 over to the obverse side 20 of the tile 10 and the central portion (C) of the first wrapper 12; and isostatic pressing the wrapped tile to integrate the wrappers 12, 14, the metal plate 26 and the tile 10 while curing the polymer.

The isostatic pressing may be carried out in a chamber of an isostatic press. The method may further include initially pressurizing the chamber to a first pressure above atmospheric pressure while at a first, ambient temperature and thereafter further increasing pressure to a second higher pressure, while increasing temperature to a second, higher temperature to cure the polymer, and holding the temperature of the chamber for a first period of time at the second temperature to cure the polymer.

The method may further include cooling the chamber from the second, higher temperature to a lower temperature above ambient temperature without venting the chamber to maintain pressure inside the chamber, and then venting the chamber while maintaining the temperature of the chamber above ambient.

The method may further include venting the chamber to atmospheric pressure while maintaining the second, higher temperature for a second period of time.

Prior to the isostatic pressing step, the wrapped tile may be sandwiched between release fabrics to obtain a sandwiched and wrapped tile. The sandwiched and wrapped tile may be placed in a vacuum bag. The vacuum bag is then evacuated, thereby squeezing the wrappers into tighter contact with the tile. The bag may be sealed to obtain an air-tight enclosure.

The plurality of wrappers may include at least a third wrapper 16 and optionally having a fourth wrapper 18, each having a central portion (C). The method may further include, prior to isostatic pressing, placing the central portion (C) of the third wrapper directly on the reverse side 22 of the tile 10 before placing the metal plate 26.

The leaves (L) of the third wrapper 16 may be folded over to the obverse side 20 of the tile 10. The fourth wrapper 18 may be wrapped in the same manner as the third wrapper 16 over the back of the second wrapper 14 prior to isostatic pressing.

The specific temperature values, pressure values, and treatment duration for each step can be based on the technique disclosed in U.S. Pat. No. 9,677,858.

The leaves (L) of each wrapper 12, 14, 16, 18 may vary in length, and the shortest leaves may be closest to the corners 24 of the tile 10.

The leaves (L) of the first wrapper 12 and the leaves (L) of the third wrapper 16 may be off-set by reversing the contacting face of the wrapper.

The tile 10 may be symmetric about a symmetry line and the shape and seam positions of the leaves (L) of the wrappers may be asymmetric about the symmetry line.

The wrappers may be star-shaped with leaves that terminate at respective points.

The polymer may be an epoxy, and the wrappers 12, 14, 16, 18 may be weaves made of carbon fibers.

A plurality of armor components made according to the method may be arranged in an imbricated pattern to make an armor system that is conformal to a body (for example, a person's torso or thigh).

The corners of the tile may be rounded.

The metal plate may be, for example, a steel sheet.

Test

To demonstrate the unexpected improvement of using a metal plate (e.g. a steel insert), three different configurations of wrapped tiles were compared. The three configurations are described below.

In each case, 32-tile (30 full tiles, four half tiles) 10 inch×12 inch "shooter's cut" panels were prepared, each panel with one of the three wrap configurations. The boron carbide tiles in all of the panels were identical, weighing 52 grams.

First Configuration

Three carbon fiber wraps were applied to a tile in the fashion described in U.S. Pat. No. 9,677,858. The first wrap had its center in contact with the reverse side 22 of the tile, and its star-tipped ends folded around to the strike face. The second wrap was in contact with the (singly-wrapped) strike face, with its ends wrapped around to the back face. The third wrap had its center in contact with the (twice-wrapped) back face, with its ends wrapped around to the strike face.

Second Configuration

This configuration included six carbon fiber wraps, with a wrapping sequence, which continued the pattern used for the three carbon fiber wraps previously described.

Third Configuration

In this configuration, one carbon fiber wrap with its center was placed in contact with the reverse side 22 and its ends wrapped around to the obverse side 20. A 12 mil sheet steel (cold worked low carbon steel, designation 1008 or 1010) insert sized to fit onto the reverse side 22 of the (singly-wrapped) boron carbide disk. That sheet surface was contoured to match the shape of the reverse side 22 of the tile (by encasing the combination of a flat steel sheet, in contact with the reverse side 22 of a boron carbide tile, in a vacuum-sealed latex bag, and cold isostatic pressing the assembly to shape the steel sheet to match the reverse side 22 of the boron carbide tile). Three more carbon fiber wraps followed with centers in contact with reverse side 22, then strike face, then again reverse side 22, as seen in FIG. 4. The overall weight of this system closely matched that of that of the six carbon fiber wrap system, the second configuration.

Figure 5:
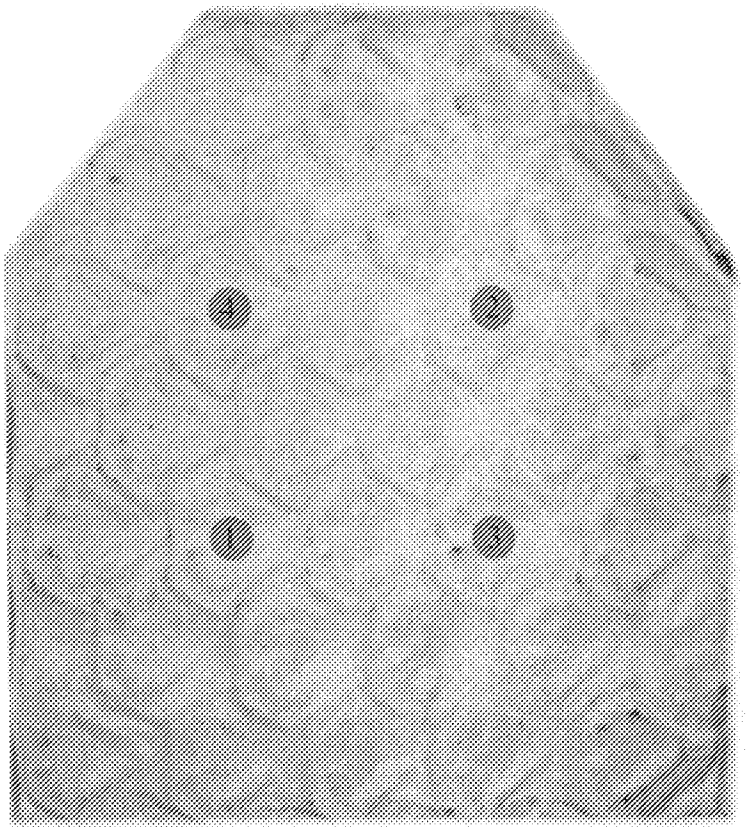
FIG. 5 shows a strike face of a panel with tile-center target locations and the shot sequence (1-4) marked for the M2 AP projectile at 2880 ft/s.

The panels were shot (Oregon Ballistics Laboratory) four times at tile-center locations, as depicted in FIG. 5. The projectile used in all cases was the M2 AP, at muzzle velocity (2880 ft/s). The figure depicts the locations and sequence of the four shots, which was identical for the three panels.

Figure 6:
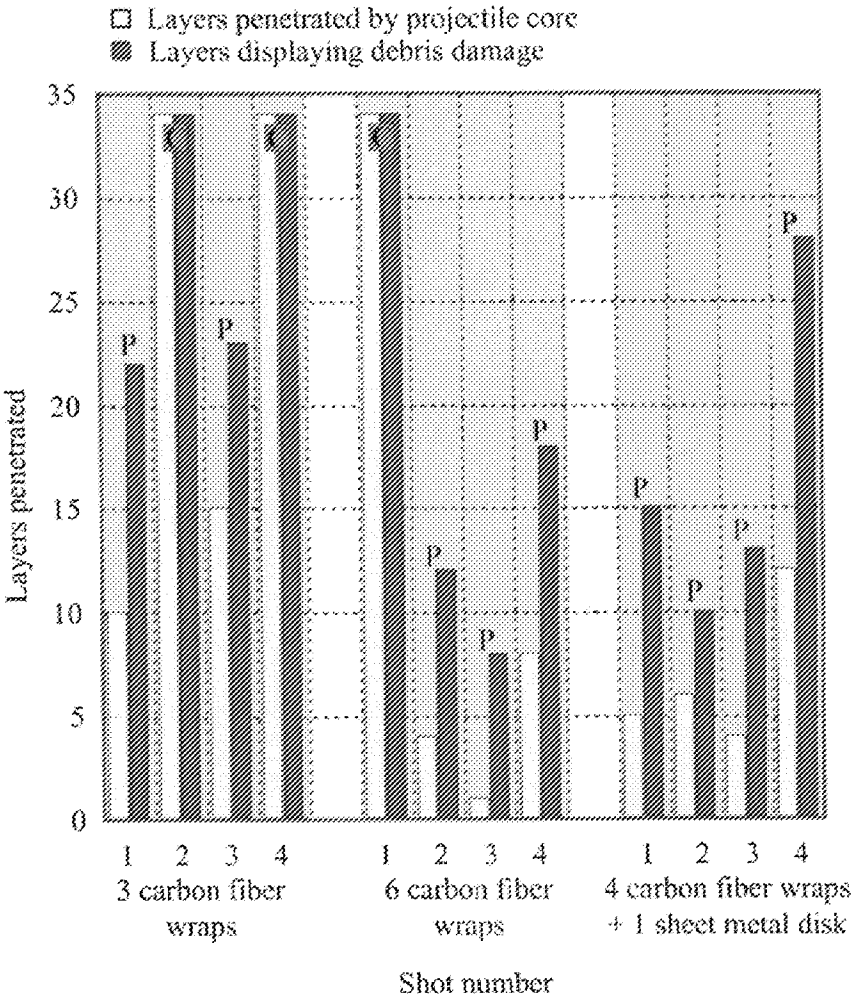
FIG. 6 shows the ballistic results for four M2 AP rounds shot into the panels, each of which had different wrapping configurations.

The results of the ballistic tests are shown in FIG. 6. The P label refers to a partial penetration—that is, the bullet was stopped by the panel. The C label refers to a complete penetration of the projectile. For bullets which were stopped by the panels, the bar graphs shown in the figure provide an indication of how close the projectile cores came to a complete penetration (a complete penetration would have penetrated 34 layers of ballistic backing fabric). The layer number of backing fabric, counting from the side closest to the strike face, in front of which the projectile was found trapped, is shown as one bar graph. As the projectile drove through the wrapped boron carbide tiles, it pushed rubblized boron carbide in front of it, which left regions of fabric damage and penetrated ceramic debris in fabric layers deeper than those at which the projectile core came to rest. The deepest layer for such damage is also indicated in the figure.

The panel with three carbon fiber-wrapped tiles (First Configuration) had two out of four stops ("P"), the panel with six carbon fiber wrapped tiles (Second Configuration) had three out of four stops, and the panel with tiles which had a steel sheet insert and four carbon fiber wraps (Third Configuration) stopped all four M2 AP rounds. The projected weight of this "shooters cut" panel (with the sheet steel insert) was 6.7 lbs. Its ability to stop four M2 AP rounds at this overall weight is unique and noteworthy.

Discussion of Results

The well-established mechanism for the advantageous ballistic performance of a hard ceramic strike face with a polymeric fiber-based backing is based on projectile dwell. When the projectile encounters the ceramic strike face, because of its high hardness, no plastic flow occurs, such as that which would occur with a bullet impacting a metal (wherein the metal would then flow out of the way of the projectile, as if a fluid). Rather, a compressive wave propagates to the reverse side 22 of the ceramic tile, which is then reflected back as a tensile wave, resulting in extensive crack formation which pulverizes the ceramic. During this time period, the projectile is forced to dwell on the strike face, collapsing on itself, and mushrooming out its cross sectional area of contact with the strike face. In some cases, this dwell causes the projectile to break up into fragments. At some point, the projectile is permitted to penetrate through as a plume of ceramic debris sprays out conically from the strike face, and flows backward and transversely out of the way of the projectile at the reverse side 22. As the projectile works its way through, the remaining ceramic rubble functions as a loose abrasive, ablating away mass, and correspondingly energy, from the projectile. The fibrous polymeric backing, via resistance from the mutual friction of fiber-pullout over extended lateral distances, fully arrests the forward movement of the projectile, or its fragments.

Figure 7B:
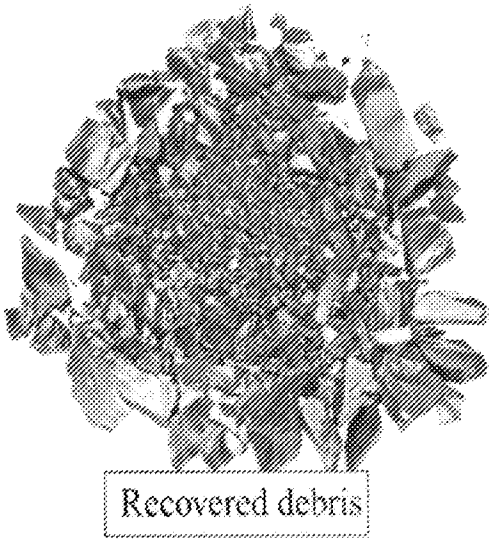
FIG. 7B shows the recovered debris, selectively positioned with fine powder at the center, and larger shards at distances extended away from the point of impact reconstructed based on the debris stuck to pieces of recovered carbon wrap as a function of lateral position from the point of impact. A similar distribution of debris particle size is observed from impacts of the larger M2 AP steel penetrator.
Figure 7A:
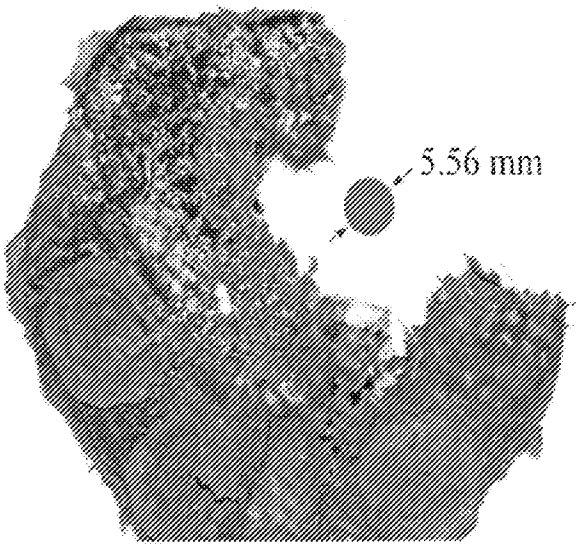
FIG. 7A shows a shot (M855A1 at 3145 ft/s) tile with three carbon fiber wraps, extracted from a shot panel with the diameter of the steel penetrator and estimated location of impact indicated.

With the carbon fiber wraps on a tile of boron carbide described herein, it is interpreted that the dwell period is increased, as the containment inhibits displacement of the rubblized ceramic out of the way of the projectile. During the enhanced dwell, further energy is absorbed by more extensively rubblizing the tightly-contained boron carbide (energy is absorbed in extensively forming new surfaces). Autopsies of shot tiles show fine powder close to the point of impact, which transitions to larger shards farther away (FIG. 7).

Figure 8A:
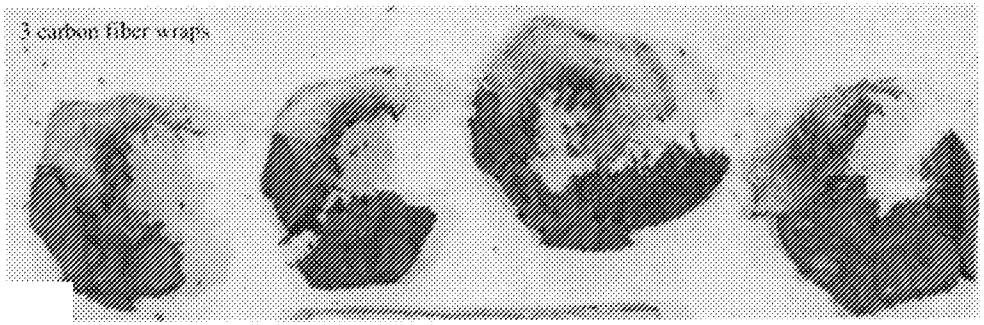
FIGS. 8A-8C show the remnants of three different configurations of wrapped tiles shot at tile centers by M2 AP rounds at 2880 ft/s.
Figure 8B:
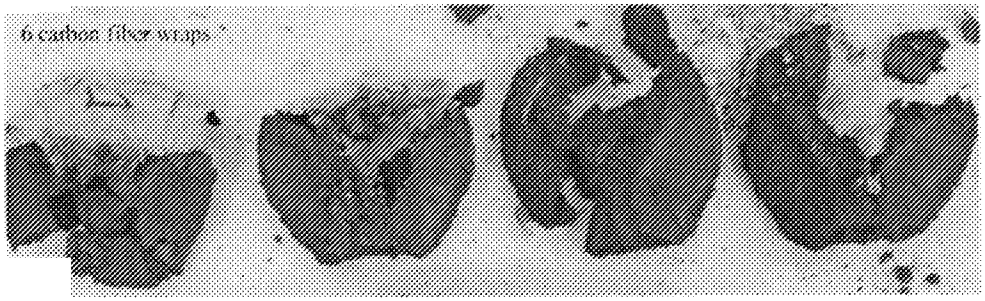
Figure 8C:
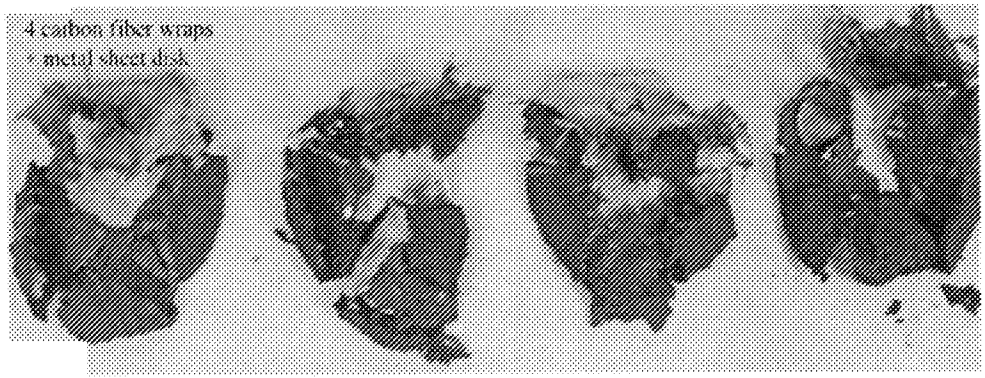

For the ballistic tests discussed herein, all tiles were shot at their centers. Shot tiles removed from the ballistic panels are shown in FIGS. 8A-8C. For the tiles with three (First Configuration) or six (Second Configuration) carbon fiber wraps (FIGS. 8A and 8B), a significant portion, much larger than the diameter of the penetrator, of the tile was fully removed with the passage of the penetrator. It is interpreted that the mechanism of failure for the system is: at regions well away from the point of impact, the boron carbide shard size was large enough by which, under the pressure applied by the projectile, these shards locally cut the wrap fibers on the reverse side 22. The reverse side 22 wrap then continued to fail by a tearing process between cut regions, driven by the force of the projectile. The net result was a circular punch-out of tile of ~3-4 times the diameter of the penetrator (7.62 mm).

Figure 9:
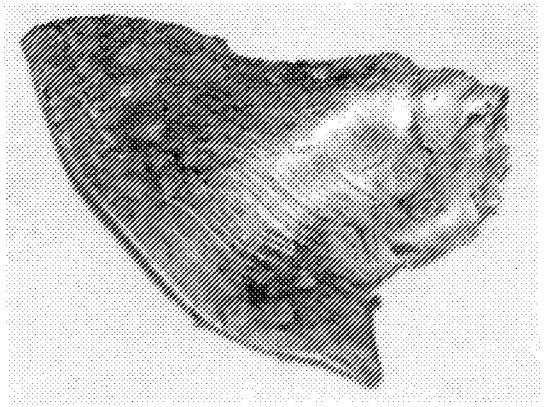
FIG. 9 shows the recovered fragment of steel sheet from a shot boron carbide tile with a steel insert and for carbon wraps.

As shown in FIG. 8*c*, the steel insert changed this mechanism of failure to one associated with a further increased dwell period. From the figure, it is apparent that these tiles are more fully destroyed as compared to those without the sheet steel insert. The remnants of the metal inserts were appreciably distorted from their original shapes via plastic deformation, and are torn into individual segments (FIG. 9). The pieces had re-shaped, in part, to the shapes of the wrapped tiles underneath and supporting the impacted tile.

It is interpreted that the steel insert first inhibited boron carbide shards from cutting the carbon fibers. This prohibited early ejection of boron carbide rubble out through the reverse side 22, imposing a greater dwell time, and facilitated more energy absorption through extensive pulverizing of the boron carbide in nearly all of the tile. Extensive tearing of the wrap was required throughout reverse side 22 and the strike face 21 before the projectile, pushing the steel sheet insert, could penetrate past its wrap containment. Even after this point, the steel sheet moved in advance of the projectile and deformed as a single unit, re-forming to shape accommodation with surrounding supporting tiles. After this point, the metal insert then tore into smaller pieces. This process significantly increased the cross sectional area of the panel interacting with and opposing the inertia of the projectile.

A key feature of this discovery is the combination of a ductile steel insert on the interior of a wrap of very high stiffness. If, for example, the ceramic were wrapped with a welded steel (or other metal) sheet enclosure, such a positive result would not be expected because the force of the bullet would deform the back face of the enclosure, opening up a volume in which ceramic debris can displace, allowing easy penetration of the projectile. A highly stiff wrap enclosure, such as carbon or glass fiber (for example, E or S glass fiber but not polymeric fiber), serves to immobilize the rubble, and force an extended dwell of the projectile. The steel sheet insert then serves the purpose of impeding the cutting action of the ceramic debris on the brittle fibers in the wrap, further enhancing dwell.

The enhanced ballistic stopping capability associated with the use of this steel insert can be exploited to produce a lighter overall panel for a given projectile threat (kinetic energy per unit area), by reducing the weight of the ceramic more than the added weight of the steel sheet insert. Parametric variations in geometric (e.g. thickness) and metal (e.g. varying the metal insert composition to alter its strength, ductility and toughness) properties of the insert will reveal further improvements in ballistic stopping power for a given threat. Further, the incorporation of form-fitting closed-cell polyurethane pad in the open space between the back of the encapsulated tile panel and the backing fabric, will provide a broad cross-sectional area of ballistic resistance against the movement of the steel insert, liberated from the torn carbon fiber wrap, as it is pushed by the projectile.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of making an armor component, the method comprising:

wrapping a ceramic tile with a plurality of wrappers impregnated with a curable polymer to obtain a wrapped tile, wherein the tile includes an obverse side, a reverse side, and corners, and the plurality of wrappers include at least a first wrapper and at least a second wrapper, each wrapper having a central portion and a plurality of leaves surrounding and extending from the central portion;

placing the central portion of the first wrapper over the obverse side of the tile;

folding the leaves of the first wrapper over to the reverse side of the tile;

placing a metal plate over the reverse side of the tile;

placing the central portion of the second wrapper over the metal plate;

folding the leaves of the second wrapper over to the obverse side of the tile and the central portion of the first wrapper; and isostatic pressing the wrapped tile to integrate the wrappers, the metal plate and the tile while curing the polymer.

2. The method of claim 1, wherein the isostatic pressing is carried out in a chamber of an isostatic press, and further comprising initially pressurizing the chamber to a first pressure above atmospheric pressure while at a first, ambient temperature and thereafter further increasing pressure to a second higher pressure, while increasing temperature to a second, higher temperature to cure the polymer, and holding temperature of the chamber for a first period of time at the second temperature to cure the polymer.

3. The method of claim 2, further comprising cooling the chamber from the second, higher temperature to a lower temperature above ambient temperature without venting the chamber to maintain pressure inside the chamber, and then venting the chamber while maintaining the temperature of the chamber above ambient.

4. The method of claim 2, further comprising venting the chamber to atmospheric pressure while maintaining the second, higher temperature for a second period of time.

5. The method of claim 3, further comprising, prior to the isostatic pressing step, sandwiching the wrapped tile between release fabrics to obtain a sandwiched and wrapped tile, placing the sandwiched and wrapped tile in a vacuum bag, evacuating the vacuum bag, thereby squeezing the wrappers into tighter contact with the tile, and sealing the bag to obtain an air-tight enclosure.

6. The method of claim 1, wherein the plurality of wrappers include at least a third wrapper and a fourth wrapper each having a central portion; and the method further comprises placing the central portion of the third wrapper on the reverse side of the tile before placing the metal plate; placing the central portion of the fourth wrapper on the second wrapper, and folding the leaves of the third wrapper and the fourth wrapper over to the obverse side of the tile, wherein the leaves of each wrapper vary in length, and the shortest leaves are closest to the corners of the tile.

7. The method of claim 6, wherein the leaves of the first wrapper and the leaves of the third wrapper are off-set by reversing the contacting face of the wrapper.

8. The method of claim 6, wherein the tile is symmetric about a symmetry line and wherein the shape and seam positions of the leaves of the wrappers are asymmetric about the symmetry line.

9. The method of claim 1, wherein the wrappers are star-shaped with leaves that terminate at respective points.

10. The method of claim 1, wherein the polymer comprises an epoxy and the wrappers comprise carbon fibers, or glass fibers.

11. A method of making armor, comprising imbricating a plurality of components made according to the method of claim 1 into an imbricated pattern.

* * * * *